US006322939B2

(12) United States Patent
Ohtsu et al.

(10) Patent No.: US 6,322,939 B2
(45) **Date of Patent: *Nov. 27, 2001**

(54) IMAGE FORMING METHOD AND IMAGE FORMING APPARATUS FOR USE IN THE METHOD

(75) Inventors: Shigemi Ohtsu; Eiichi Akutsu; Lyong Sun Pu, all of Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/474,086

(22) Filed: Dec. 29, 1999

Related U.S. Application Data

(62) Division of application No. 09/186,446, filed on Nov. 5, 1998, now Pat. No. 6,025,101.

(30) Foreign Application Priority Data

Dec. 16, 1997 (JP) ..... 9-346781

(51) Int. Cl.[7] ..... G03G 17/02
(52) U.S. Cl. ..... 430/52; 399/159; 399/168
(58) Field of Search ..... 430/52; 399/159, 399/168

(56) References Cited

U.S. PATENT DOCUMENTS 6,025,101 * 2/2000 Ohtsu et al. ..... 430/52

FOREIGN PATENT DOCUMENTS

| | | |
|---|---|---|
| A-59-50604 | 12/1984 | (JP) . |
| A-63-237085 | 10/1988 | (JP) . |
| A-4-104101 | 4/1992 | (JP) . |
| 5-119209 | 5/1993 | (JP) . |
| 5-150112 | 6/1993 | (JP) . |
| 5-157905 | 6/1993 | (JP) . |
| A-6-116540 | 4/1994 | (JP) . |
| B2-2-603468 | 1/1997 | (JP) . |
| A-9-34147 | 2/1997 | (JP) . |
| WO 95/00593 | 1/1995 | (WO) . |

OTHER PUBLICATIONS

M. Futsuhara et al., "A Micropattern Formation by the Photoinduced Electrodeposition Coating", *Journal of the Oil and Colour Chemists' Association.* Techno–Cosmos, Mar. vol. 1, 1992.

* cited by examiner

*Primary Examiner*—Mark Chapman
(74) *Attorney, Agent, or Firm*—Oliff & Berridge, PLC

(57) ABSTRACT

An image is formed by a process comprising the steps of: preparing a substrate comprising a transparent substrate having formed thereon a transparent electroconductive film and a semiconductor thin film in this order; preparing in a vessel, which can hold an liquid, an aqueous liquid containing a coloring material and an electrodepositable material capable of chemically dissolving or sedimanting/precipitating depending on the change in the pH; connecting a device than can supply an electric current or an electric field in accordance with an image pattern to the transparent electroconductive film of the substrate; fixing the substrate so that the semiconductor thin film is immersed in the aqueous liquid; disposing a counter electrode as another member of an electrode pair in the vessel; disposing a prescribed photomask on the transparent substrate of the substrate; and carrying out light irradiation at the transparent substrate through the photomask so that an electrodeposited film containing the electrodepositable material is formed selectively on portions where electromotive force is generated by the light irradiation.

8 Claims, 9 Drawing Sheets

IMAGE FORMING METHOD AND IMAGE FORMING APPARATUS FOR USE IN THE METHOD

This is a Division of application Ser. No. 09/186,446 filed Nov. 5, 1998 now U.S Pat. No. 6,025,101. The entire disclosure of the prior application is hereby incorporated by reference herein in its entirety.

BACKGROUND OF THE INVENTION

1. Field of the Invention

The present invention relates to an image forming method for forming an image on an organic or inorganic semiconductor substrate with an electrochemical reaction, and to an image forming apparatus suited for use in the image forming method.

2. Description of the Related Art

Methods that are currently utilized in a printer or the like for the purpose of transferring an image from an electric signal or optical signal to a recording medium such as paper include, for example, dot-impacting, thermal transfer, thermal sublimation, ink jet, and electrbphotographic methods of laser printers. These methods are roughly divided into three groups.

The methods that are included in the first group are those based on, for example, dot-impacting, thermal transfer, and thermal sublimation. According to such methods, a sheet, which is in the form of an ink ribbon or a donor film and which contains a dispersed dye, is superposed on paper or the like and a dye is transferred to the paper by an application of a mechanical impact or heat. The methods that are included in the second group are those based on, for example, an ink jet method, in which an ink is directly transferred to paper from a head. The methods that are included in the third group are those based on electrophotographic methods of laser printers and the like in which toner particles are made to adhere to an electrostatic latent image created by laser spots on a photoreceptor and then the toner particles are transferred to paper to form an image.

Problems associated with these methods are as follows. In the case of the methods of the first group which require pressing and heating, problems are difficulty in high-speed operation, poor energy efficiency, and high running costs. In the case of the methods of the second group, a problem is difficulty in high-speed operation, because it is difficult to electrically control ink dots and to form a head corresponding to the width of the paper. Another problem is that the minimal image unit is restricted by the size and interval of the head. In the case of the. methods of the third group, which are electrophotographic methods, problems include the fact that a high voltage is necessary to form an electrostatic latent image and to adhere/transfer toner particles and a large amount of electricity is consumed, generating ozone and nitrogen oxides.

In conclusion, none of the image forming methods adopted in printers and the like at the present time is a general-purpose method leading to a high-quality image, a relatively high speed, a low level of running costs, energy saving, resource saving, and advantages for both the environment and for users. This is because an image forming method in which a dye is directly controlled at a molecular level to form an image has not been established.

After studying the principles of these electrodeposition technologies, the present inventors have found that some water-soluble dye molecules significantly change their solubility in water depending on their states, i.e., an oxidized state, a neutral state, or a reduced state.

Examples of compounds having such a property are as follows. Rose Bengal and eosine, which are each a fluorescein dye, are in a reduced state and are soluble in water at a pH value of 4 or more. But, at a pH value of less than 4, these dyes are oxidized to a neutral state, depositing and/or precipitating in water. Further, it is generally known that the solubility of a dye having a carboxyl group significantly changes depending on the hydrogen ion concentration (pH) of the solution even if a structural change of the dye does not take place. Specifically, an ink-jet dye whose water resistance has been improved dissolves in water at a pH value of 6 or more but precipitates at a pH value of less than 6. If electrodes are immersed in a solution comprising any of these dyes dissolved in pure water and voltage is applied, an electrodeposited film composed of the dye molecules is formed on the anode. Likewise, a water-soluble acrylic resin, which is a polymer having a carboxyl group, dissolves in water at a pH value of 6 or more but precipitates at a pH value of less than 6. If electrodes are immersed in a liquid comprising a pigment dispersed in a solution of the polymer and a voltage is applied, the pigment and the polymer are deposited on the anode to thus form an electrodeposited film comprising a mixture of the pigment and the polymer. These electrodeposited films can be redissolved in a solution either by applying a reverse voltage or by immersing the films in a solution having a pH value in the range of 10 to 12. Meanwhile, an oxazine-based basic dye, i.e., Cathilon Pure Blue 5GH (C.I. Basic Blue 3), and a thiazine-based basic dye, i.e., Methylene Blue (C.I. Basic Blue 9), which are each a quinoneimine dye, are in an oxidized state at a pH value of 10 or less and are colored. But, at a pH value greater than that, these dyes are brought to a reduced state, becoming insoluble and depositing. If electrodes are immersed in a solution comprising any of these dyes dissolved in pure water and a voltage is applied, an electrodeposited film composed of the dye molecules is formed on the cathode. These electrodeposited films are redissolved in a solution either by applying a reverse voltage or by immersing the films in a solution having a pH value of 8 or less.

According to traditional electrodeposition technology, the voltage required for the formation of an electrodeposited film is as highas about 70V. If such a high voltage is applied, an image cannot be formed because the Schottky barrier between the semiconductor and the electrolyte solution is destroyed.

Although a method is proposed in which a dye is used in doping/dedoping of an electroconductive polymer so that an image is formed with light, an electrodeposited film can be formed with a dye alone without the use of an electroconductive polymer. However, the voltage required for forming the electrodeposited film with the dye alone is larger than the voltage required for the formation of the electrodeposited film in the presence an electroconductive polymer. Meanwhile, the photovoltaic force of a general-purpose Si-based photo-semiconductor is about 0.6V, which by itself is insufficient for image formation. Accordingly, although measures are contrived such as application of a bias voltage to bolster the voltage, avoltage larger than a certain value (i.e., avoltage that depends on the band gap of the semiconductor to be used) destroys the Schottky barrier, which is required for the formation of the photovoltaic force and which is present between the semiconductor and the electrolyte solution. Accordingly, the bias voltage to be applied should not exceed a limit. Because of this, image forming methods effected in an aqueous solution by using photovoltaic force have been limited to methods that use a photopolymerization reaction of an electroconductive polymer capable of undergoing an oxidation-reduction reaction at a voltage of 1.0V or less such as polypyrrole. In Japanese Patent Application Laid-Open (JP-A) No. 5-119,209 ("A method for manufacturing a color filter and an electrodeposition substrate for manufacturing the color filter") and JP-A No. 5-157,905 ("A method for manufacturing a color filter"), which are well-known in this field, the electrodeposition voltage is as high as 20 to 80V and the electrodepositable material utilizes an oxidation-reduction reaction of a polymer. Accordingly, the voltage that is required for electrodeposition of polymers generally known as a material for electrodeposition coating, is 10V or more. Therefore, despite attempts such as attempt to utilize for image formation the photoconductive property of $ZnO_2$, which is used in electrophotography, a practical electrodepositable material that can be easily handled and can beused in an aqueous liquid has not yet been found.

SUMMARY OF THE INVENTION

Accordingly, a first object of the present invention is to provide an image forming method characterized by 1) a low level of running costs, 2) high resolution and a high-quality image, 3) capability of creating a continuous density gradation, 4) energy saving, low costs, and high efficiency, 5) advantages for both the environment and for users, and 6) an applicability for general purposes that can be well anticipated. That is, the first object is to provide an image forming method in which a dye is directly controlled at a molecular level for image formation.

A second object of the present invention is to provide an image forming method in which the image produced in the above-described way is transferred to an appropriate transfer-receiving medium to thereby provide an image having good storability.

A third object of the present invention is to provide an image forming apparatus suited for the image forming method.

In order to achieve these objects, the present inventors have studied a fresh the principles of electrodeposition technologies. And, they have studied the properties of the previously described molecule whose solubility in water significantly changes. The phase changes of dissolution for deposition/precipitation due to the change in the solubility of the molecule can be caused either by direct electrochemical oxidation-reduction of the molecule or by a change in the pH of the aqueous solution in which the molecule is dissolved. A material whose phase changes electrochemically as described above is hereafter referred to as an electrodepositable material as suitable.

According to the present invention, an image forming method comprises comprising the steps of: preparing a substrate composed of a transparent substrate having formed thereon a transparent electroconductive film and an organic or inorganic semiconductor film in this order, peparing in a vessel, which can hold an liquid, an aqueos liquid containing a coloring material and an electrodepositable material capable of chemically dissolving and depositing/precipitating depending on the change in the pH, disponding, in said vessel, a device having a counter electrode which is another member of a pair of electrodes and securing the substrate, in which means capable of providing a current or an electric field is connected to the transparent electroconductive film, such that a semiconductor thin film is immersed in the aqueous liquid; and carrying out light irradiation at the transparent substrate so that an electrodeposited film cantaining the electrodepositable material is deposited selectively on portions where electromotive force is generated by the light irradiation, to thereby form an image.

According to this method, if electrodes are immersed in an aqueous liquid prepared by dissolving or dispersing an electrodepositable material in an aqueous liquid and a voltage is applied, an electrodeposited film comprising the electrodepositable material is formed on the anode. In a case where the electrodepositable material is a colorless or slightly colored polymeric material, if electrodes are immersed in an aqueous liquid prepared by dispersing a coloring material such as a pigment in this polymer and a voltage is applied, the polymer containing the coloring material is deposited on the anode, thus providing a colored electrodeposited film containing a mixture of the pigment and the polymer. In a case where the electrodepositable material itself is a colored material, if electrodes are immersed in an aqueous liquid comprising the electrodepositable material and a voltage is applied, a colored electrodeposited film is formed without the necessity of using a particular coloring material. In the present invention, "a coloring material and an electrodepositable material which chemically dissolves or deposits/precipitates depending on the change in the pH" is construed to include an electrodepositable material that is a dye that serves as a coloring material by itself. These electrodeposited films can be redissolved in a solution either by applying a reverse voltage or by immersing the films in a solution having a high-solvency pH value (i.e., a pH value in a range of 10 to 13 in a case of an anionic electrodepositable material and a pH value in a range of 1 to 4 in a case of a cationic electrodepositable material).

The term "an aqueous liquid" as used herein is a generic term for an aqueous solution or an aqueous dispersion which are prepared by dissolving or dispersing part or whole of electrodepositable materials (such as a dye, a pigment, a polymeric compound, and others) in an aqueous medium.

To form the electrodeposited film, a voltage equal to or larger than a threshold voltage is necessary. Therefore, a flowing electric current does not necessarily produce an electrodeposited film. Accordingly, in a case where a bias voltage is appled, an imag e may be formed even if an externally applied voltage is low. Based on this principle, if a transparent semiconductor layer formed on a substrate for electrodeposition is irradiated with light serving as an input signal, a desired electrodeposited film can be formed at desired portions. The electrodeposited film thus formed is hereafter referred to as a photoelectrodeposited film.

Accordingly, an electrodeposited film is produced from the electrodepositable material by a sum of the electromotive force generated by irradiation of the semiconductor layer with light and the bias voltage to be applied to the transparent electrode. Since the bias voltage to be applied can be adjusted at will in accordance with the photovoltaic force, the application of the bias voltage to the transparent electrode may be omitted if the photovoltaic force of the semiconductor is sufficient for the formation of the electrodeposited film.

The image forming technology utilizing a photoelectrodeposited film as proposed herein by the present inventors is based on the above-described findings. To put it briefly, the image forming method comprises the steps of utilizing a transparent organic or inorganic semiconductor as the substrate and irradiating the transparent substrate with light so that the electrodepositable material containing (or serving also as) the coloring material, which is in the aqueous solution, is deposited from the aqueous solution in the form of a colored electrodeposited film on the semiconductor substrate. The image forming method of the present invention makes it possible to form a photoelectrodeposited film having high resolution by utilizing a Schottky junction between the transparent semiconductor film and the solution for electrodeposition, or alternatively by utilizing a pn junction or a pin junction of the transparent semiconductor film itself.

In a case where amorphous silicon is used as the substrate, it is desirable to use an electroconductive n-type SiC or p-type SiC as a protective layer for the prevention of an increase in electric resistance.

Further, when it is desired to apply light from the backside of the transparent substrate, it is preferable to increase the efficiency as an n-type semiconductor by reducing in a hydrogen atmosphere a $TiO_2$ thin film, which is prepared by a vapor-deposition process or a sol/gel process. In a case where a pn junction of an organic semiconductor is used, a preferred example is a two-layered structure comprising a phthalocyanine derivative as a p-type semiconductor and a perylene derivative as an n-type semiconductor.

In a case of providing the image produced by the electrodeposited film according to the present invention with gradations, the following may be carried out: during forming of the image by irradiating the above-mentioned transparent substrate with light to selectively deposit the electrodeposited film containing the electrodepositable material at portions at which photovoltaic force was generated with light irradiation, the image is made to exhibit gradation by controlling the amount of the electrodeposited film, through adjusting the amount of the electric charges during electrodeposition by controlling at least one parameter selected from: a) the strength of the bias voltage tobe applied, b) time period of light irradiation, and c) the strength of the light of the light irradiation.

The electrodeposited film obtained by the image forming method of the present invention can be transferred to a suitable transfer-receiving medium. The transfer can be performed appropriately by bringing the electrodeposited film into contact with the transfer-receiving medium and then applying heat and/or pressure to the electrodeposited film and the transfer-receiving medium which are in contact with each other, or alternatively, by bringing a transfer-receiving medium that is alkaline or acidic into contact with the electrodeposited film if the electrodeposited film is composed of an anionic compound or a cationic compound.

The image forming apparatus of the present invention comprises a substrate composed of a transparent substrate having formed thereon a transparent electroconductive film and an organic or inorganic semiconductor film in this order, a vessel filled with an aqueous liquid containing a coloring material and an electrodepositable material capable of chemically dissolving and depositing/precipitating depending on the change in the pH, means capable of supplying.an electric current or an electric field at least in accordance with an image pattern, a counter electrode as another member of an electrode pair, and a light source designed to carry out light irradiation at the transparent substrate disposed on the substrate, wherein the means capable of supplying the electric current or the electric field is connected to the transparent electroconductive film; the substrate is fixed so that a semiconductor thin film is immersed in the aqueous liquid; and the counter electrode is immersed in the aqueous liquid inside the vessel.

DESCRIPTION OF THE PREFERRED EMBODIMENTS

Figure 1A:
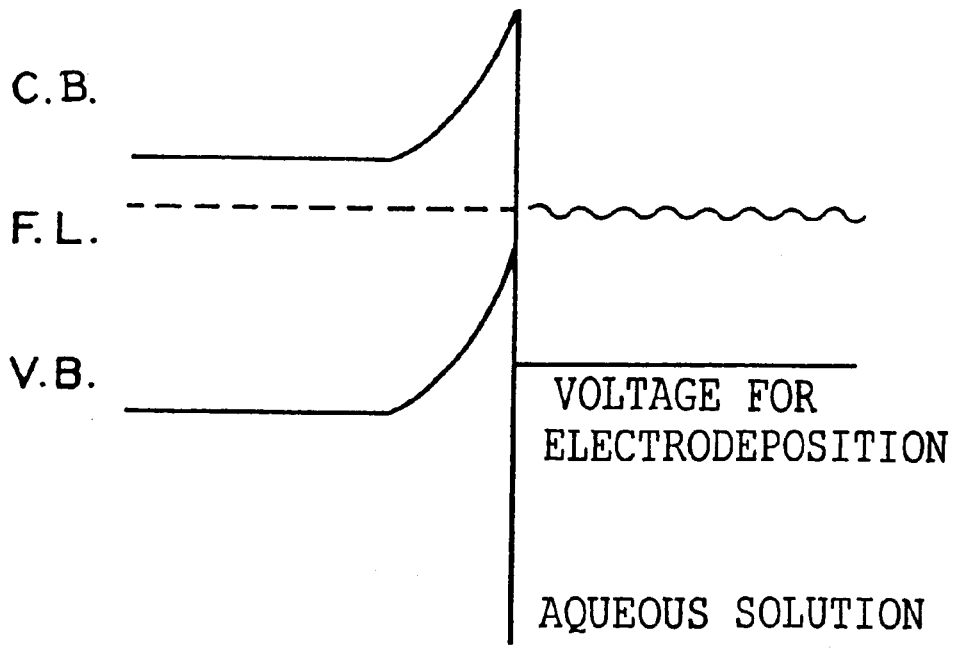
FIGS. 1A and 1B are diagram, schematically illustrating energy bands for FIG. 1A a Schottky junction and for FIG. 1B a pin junction.

The present invention is explained in detail below.

First of all, carrying out the present invention necessitates a molecule (electrodepositable material) whose solubility varies depending on the changes in the pH such as alkalinity or acidity, or alternatively, varies depending on electrochemical changes, so that dissolution or deposition/precipitation of the molecule occurs. The electrodepositable material may be a dye itself or may comprise a transparent polymer which is deposited from an alkaline or acidic liquid; a coloring material may be dispersed together with this polymer. In a case in which a coloring material is dispersed in the polymer, not only a dye but also a pigment can be used as the coloring material. When forming an image which requires a high level of light-fastness, it is desirable to use an electrodepositable material comprising a water-soluble polymer with a pigment dispersed therein.

Compounds that exhibit phase changes between dissolution and deposition/precipitation according to variations in electrochemical conditions are as follows. For example, the compound can be a dye. An example of the dye is Rose Bengal or eosine which is fluorescein dye that is in a reduced state and is soluble in water at a pH value of 4 or more but are oxidized to a neutral state and deposit/precipitate in water at a pH value of less than 4. Another example is a dye which has a carboxyl group, the solubility of which significantly changes depending on the hydrogen ion concentration (pH) of the solution even if a structural change of the dye is not involved (specific examples of this dye include an ink-jet dye with improved water resistance, which dissolves in water at a pH value of 6 or more but precipitates at a pH value of less than 6). Further, the above-mentioned compound can be a polymeric material. An example of the polymeric material is a specific water-soluble acrylic resin, which is a polymer having a carboxyl group that dissolves in water at a pH value of 6 or more but precipitates at a pH value of less than 6. Further, an oxazine-based basic dye, i.e., Cathilon Pure Blue 5GH (C.I. Basic Blue 3), and a thiazine-based basic dye, i.e., Methylene Blue (C.I. Basic Blue 9), which are each a quinoneimine dye, are in an oxidized state and are colored at a pH value of 10 or less. But, at a pH value greater than that, these dyes are brought to a reduced state and become insoluble, thereby depositing. If electrodes are immersed in a solution comprising any of these dyes dissolved in pure water and a voltage is applied, an electrodeposited film composed of the dye molecules is formed on the cathode. These electrodeposited films can be redissolved in solutions either by applying a reverse voltage or by immersing the films in solutions having a pH value of 8 or less.

These materials whose phase changes electrochemically are hereafter referred to as an electrodepositable material on occasion. If electrodes are immersed in an aqueous solution prepared by dissolving the electrodepositable material in pure water and a voltage is applied, an electrodeposited film comprising the electrodepositable material is formed on the anode. In a case where the electrodepositable material is a colored material, a colored electrodeposited film is formed without the use of a particular coloring material. In a case where the electrodepositable material is a colorless or slightly colored polymeric material, when electrodes are immersed in an aqueous liquid prepared by dispersing a pigment in the polymer and a voltage is applied, the polymer together with the pigment deposits on the anode, thus forming a colored electrodeposited film containing a mixture of the pigment and the polymer. These electrodeposited films can be redissolved in solutions either by applying a reverse voltage or by immersing the films in solutions having a high-solvency pH value (i.e., a pH value in the range of 10 to 13 in the case of an anionic electrodepositable material and a pH value in the range of 1 to 4 in the case of a cationic electrodepositable material).

To form of the electrodeposited film, a voltage larger than a threshold voltage is necessary. Therefore, a flowing electric current does not necessarily produce an electrodeposited film. Accordingly, in a case where a bias voltage has been applied, an image can be formed even if the voltage input level inputted from outside is low. Based on this principle, if a semiconductor is used as a substrate on which electrodeposition will take place and light is used as the input signal, a desired electrodeposited film can be formed at desired portions of the substrate. The electrodeposited film thus formed is hereafter referred to as a photoelectrodeposited film.

What is described above is explained below by taking up Pro Jet Fast Yellow 2, which is an acid dye capable of forming an electrodeposited film by itself manufactured by Geneca Corp., as an example of the compounds capable of forming the above-mentioned photoelectrodeposited film. This dye easily dissolves in pure water (pH 6–8) and is present as an anion in an aqueous solution. However, it becomes insoluble and precitates if the pH becomes 6 or less. If aplatinum electrode is immersed in an aqueous solution of Pro Jet Fast Yellow 2 and an electric current is passed through, the OH_ ions of the aqueous solution are consumed in the vicinity of the anode, converting into $O_2$. As a result, the amount of hydrogen ions increases, thereby lowering the pH value. This is because the following reaction, in which holes (p) combine with OH_ ions, occurs in the vicinity of the anode.

$$20H_+2P_+ \rightarrow 1/2(O_2)+H_2O$$

For this reaction, a certain level of voltage is necessary, and the pH decreases because the hydrogen ion concentration in the solution increases as the reaction proceeds. Accordingly, if a voltage greater than a certain voltage is applied, the solubility of Pro Jet Fast Yellow 2 drops to an extent that Pro Jet Fast Yellow 2 becomes insoluble in the vicinity of the anode, thus forming a thin film on the anode.

In order to obtain a threshold voltage of the above-mentioned value, the present invention utilizes photovoltaic force generated by irradiating a semiconductor with light. Various attempts to utilize such photovoltaic force have been already made. For example, according to A. Fujishima and K. Honda, Nature, Vol. 238 (1972), p. 37, electrolysis of water was effected by irradiating $TiO_2$, which is an n-type semiconductor, with light. According to Yoneyama et al., J. Electrochem. Soc., p. 2414 (1985), as part of studies on photoelectrochromism, an image was formed by doping/dedoping of polypryrrole, which was obtained by the electrochemical polymerization of pyrrole, on a Si substrate irradiated with light. The present inventors have also filed an application for a patent for an invention of an image forming method in which a dye is used for doping/dedoping of an electroconductive polymer and light is used for image formation.

Although an electrodeposited film can be formed by a dye alone without the use of an electroconductive polymer, the voltage required for forming the electrodeposited film with the dye alone is larger than the voltage required for the formation of the electrodeposited film in the presence of the electroconductive polymer. Meanwhile, since the photovoltaic force of an Si-based semiconductor is 0.6V at the highest, photovoltaic force by itself is insufficient for image formation. Accordingly, although methods such as application of a bias voltage for bolstering the voltage level are contrived, a voltage larger than a definite value (i.e., a voltage which depends on the band gap of the semiconductor to be used) destroys the Schottky barrier, which is required for the formation of the photovoltaic force and which is present between the semiconductor and the electrolyte solution. Accordingly, the bias voltage to be applied should not exceed a limit. Because of this, an image forming method effected in an aqueous solution by utilizing oxidation-reduction of a substance induced by photovoltaic force, has been limited to a method which uses photopolymerization of an electroconductive polymer capable of undergoing an oxidation-reduction reaction at a voltage of 1.0V or less such as polypyrrole.

However, the present inventors utilize the difference in solubility depending on the pH of the molecule for image formation, making it possible to form a colored polymer layer with a lower voltage and to form a colored image with an electrodeposited film produced by electromotive force generated by using a variety of semiconductors.

From the viewpoint of the depositability and the stability of the deposited film, a preferred transparent polymer for use as an electrodepositable material is a copolymer having an acid value in a range from 30 to 600 that has in a molecule thereof a hydrophobic group and a hydrophilic group wherein the number of the hydrophobic groups accounts for 40 to 80% of the total number of the hydrophobic and hydrophilic groups in the monomer units constituting the polymer molecule, and 50% or more of the hydrophilic groups can reversibly change from a hydrophilic group to a hydrophobic group with a change in the pH. If a coloring material in the form of particles is used together with the transparent polymer, a colored layer having excellent light-fastness can be formed. Further, as described previously, it is also possible to use a compound having in a molecule thereof a unit that deposits/precipitates depending on the pH, together with a unit that serves as the coloring material.

Next, a substrate for use in the image forming method of the present invention is described. Although the substrate is preferably transparent because of the use of photovoltaic force in the formation of an image (electrodeposited film) in the present invention, a transparent substrate is not always required, depending on the direction of irradiation with light.

Preferred examples of the substrate include a glass substrate and an amorphous silicon substrate, which are each suited for use as a substrate of a semiconductor. Firstly, a transparent electroconductive layer is formed on the substrate; this electroconduntive layer can be any of known electroconductive layers exemplified by a general-purpose ITO layer.

An organic or inorganic semiconductor layer is formed on this transparent electroconductive layer. Basically, any semiconductor thin film capable of generating electromotive force with light irradiation can be used as this semiconductor layer. specific examples of the organic semiconductor include a phthalocyanine derivative, a perylene derivative, polyvinyl carbazole (PVK), and polyacetylene. Specific examples of the inorganic semiconductor include Ga-N, diamond, C-BN, Si, SiC, Ga, GaAs, CdS, CdSe, CdTe, AlSb, InP, ZnSe, $TiO_2$, and ZnO.

Among these substances, preferable are titanium oxide and zinc oxide whose electromotive forces are not reduced by the formation of an oxide film. In particular, because of the transparency characterized by the absorption that takes place only at 400 nm or less, titanium oxide, as it is, can be used as a substrate for image formation. Recently, titanium oxide as an n-type semiconductor having good characteristics can be obtained by various processes such as a sol-gel process, a sputtering process, an electron beam vapor deposition process, and the like.

$TiO_2$, which is a suitable transparent semiconductor, is described below. $TiO_2$ is a transparent oxide semiconductor that generates photovoltaic force when irradiated with ultraviolet light. Therefore, if the backside of a transparent substrate is irradiated with ultraviolet light, a photoelectrodeposited film is formed on the surface of the transparent substrate. Various processes for preparing a $TiO_2$ film are known. Examples of well-known processes include a thermal oxidation process, a sputtering process, an electron beam process (EB process), and a sol-gel process. The present inventors have tried to prepare a $TiO_2$ film by an EB process and a sol-gel process. However, the efficiency in generating a photocurrent of a $Tio_2$ film obtained by an ordinary process was so poor that a photocurrent sufficient for electrodeposition did not flow. For this reason, the present inventors carried out a reduction treatment in order to raise the conversion efficiency in generating a photocurrent. A common condition of the reduction treatment is heating to a temperature of about 550° C. in a hydrogen atmosphere. For example, a treatment is carried out by heating to a temperature of about 550° C. for about 1 hour in a hydrogen atmosphere according to Y. Hamasaki et al., J. Electrochem. Soc., Vol. 141 (1994) , No.3, p.660. By contrast, the present inventors have obtained a satisfactory effect with a treatment at a lower temperature and for a shorter period of time, i.e., heating to a temperature of about 360° C. for about 10 minutes. This treatment was achieved by heating in an atmosphere where a hydrogen/nitrogen gas mixture containing 3% of hydrogen gas flowed at a flow rate of 1 liter per minute.

In the case of a Si-based semiconductor which has been put to practical use in a solar cell and the like, an oxide film composed of $SiO_2$ is naturally formed even in the atmosphere. Since the $SiO_2$ is an insulator, the electric resistance thereof is undesirably high for use as a substrate foran electrodeposited film. Another problem associated with the Si-based semiconductor is that the electric resistance increases as the oxide film increases in a solution and the amount of electric current increases. This problem can be solved by providing a protective layer of the oxide film on the semiconductor layer. It is desirable that the protective layer does not impair the characteristics of the underlying semiconductor and that the protective layer itself is a semiconductor. In a case of a Si-based semiconductor, the use of SiC as the protective layer is preferable. SiC is a substance the film of which can be formed both as an n-type semiconductor and as a p-type semiconductor and is a substance that can control the electrical conductivity of the semiconductor. SiC is desirable as a protective layer of Si, because SiC is very compatible with Si and does not form an oxide film. The present inventors have succeeded in eliminating the oxide film-related voltage reduction.

Both n-type semiconductors and p-type semiconductors can be used as the substrate for image formation according to the present invention. A multilayered structure which incorporates a pnjunction or a pin junction is desirable, because this structure brings about improved contrast by allowing a photocurrent to flow well and ensuring good electromotive force.

Figure 1B:
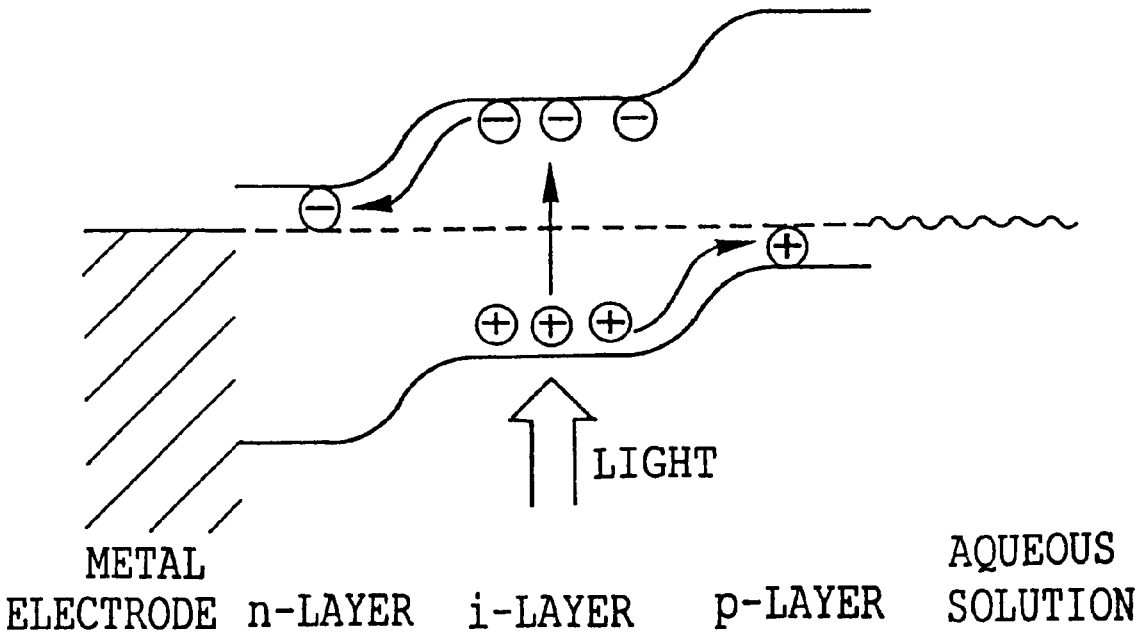

The selection of a combination of a semiconductor and an electrodepositable material depends on the polarity of the semiconductor to be used. For the purpose of generating photovoltaic force, use is made of a Schottky barrier formed in an interface adjoining the semiconductor, or alternatively, of a pn or pin junction, as is well known in formation of a solar cell. In order to explain this mechanism through an example, FIGS. 1A and 1B show diagrams schematically illustrating an n-type semiconductor. FIG. 1A shows a Schottky junction, while FIG. 1B shows a pin junction. In a case where a Schottky barrier is present between an n-type semiconductor and a solution, a current flows in a forward direction if the semiconductor is given a negative polarity, whereas no current flows if the semiconductor is given a positive polarity. However, in a state where no current flows because the semiconductor is given apositive polarity, an electric current is generated if the semiconductor is irradiated with light because electron-hole pairs are generated in the semiconductor and the holes move toward the side facing the solution. In this case, since the electrodepositable material needs to be a negative ion because of the positive polarity of the semiconductor, a combination of an n-type semiconductor and an anionic molecule is employed. Conversely, if a p-type semiconductor is used in the case described above, a cationic material is electrodeposited.

Generally, the photovoltaic force is 0.6V at the highest even in a case of a relatively large Si-based semiconductor. However, the kinds of materials which can be electrodeposited by 0.6V are limited. Therefore, the voltage deficiency needs to be filled with an application of a bias voltage. An upper limit of the bias voltage is determined by the limit at which a Schottky barrier can be maintained. If the Schottky barrier is destroyed, an image cannot be formed on the substrate, because an electric current flows even in a nonirradiated area and, therefore, the electrodeposited film is formed at the entire area of the semiconductor substrate. For example, in a case where a material capable of being electrodeposited by the application of 2.0V is used, if the substrate is irradiated with light after applying a bias voltage of 1.5V to the substrate, a photoelectrodeposited film is formed on the irradiated area alone, because of 0.6V, i.e., the photovoltaic force of the semiconductor, added to 1.5V, i.e., the voltage, is 2.1V, which exceeds a threshold voltage required for electrodeposition.

Figure 2A:
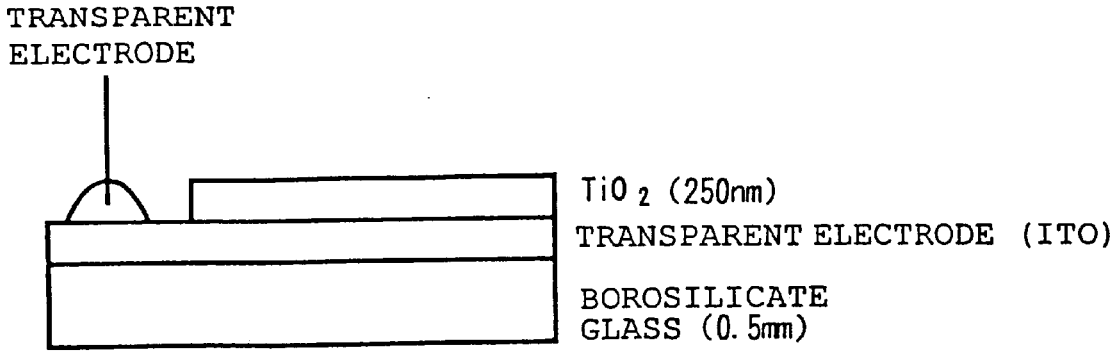
FIG. 2A is a sectional view schematically illustrating a structure of a transparent n-type semiconductor substrate.
Figure 2B:
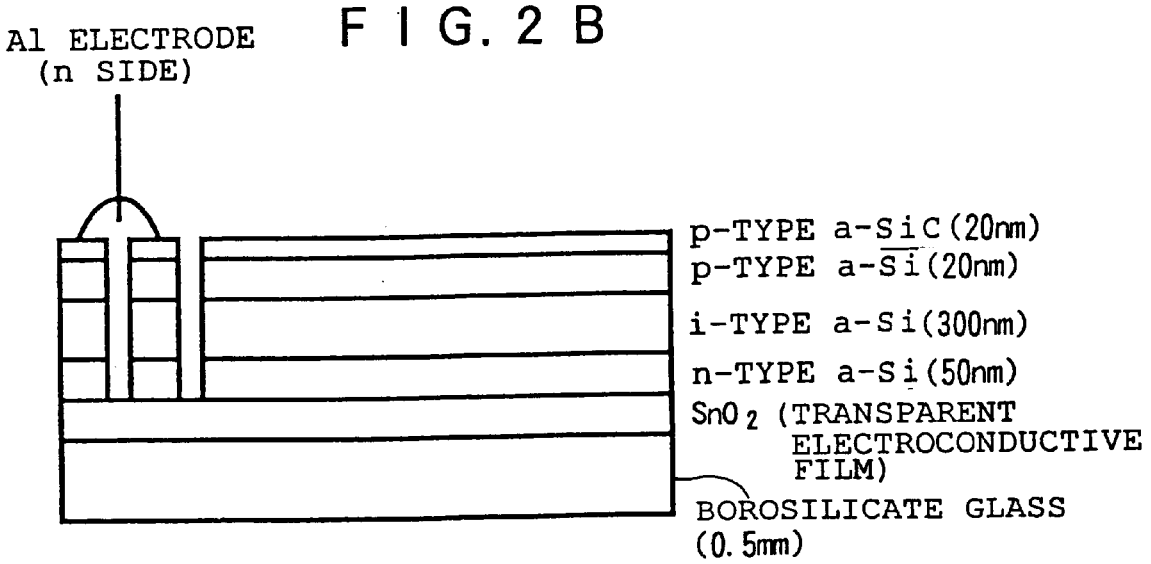
FIG. 2B is a sectional view schematically illustrating a structure of a transparent a-Si substrate having a pin structure.
Figure 2C:
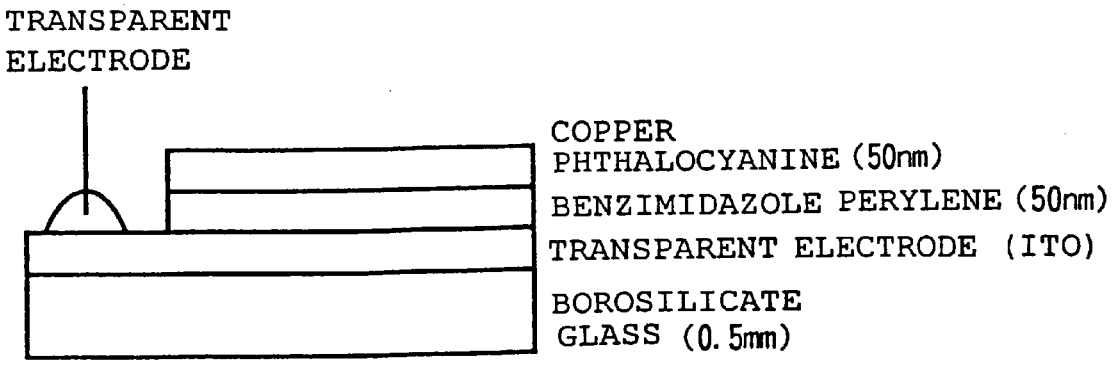
FIG. 2C is a sectional view schematically illustrating a structure of an organic substrate having a pn-junction.

A structure of a semiconductor substrate suited for use in the image forming method of the present invention is described below. FIG. 2A is a sectional view schematically illustrating a structure of a transparent n-type semiconductor substrate. A transparent electrode (ITO) is disposed on a borosilicate glass substrate (having a thickness of 1.0 mm), and a 250 nm thick titanium oxide semiconductor layer is formed on the transparent electrode. FIG. 2B is a sectional view schematically illustrating a structure of an a-Si (amorphous silicon) substrate having a pin structure. A borosilicate glass substrate (having a thickness of 1.0 mm) has formed thereon a $SnO_2$ transparent electrode as a transparent electrode, an n-type a-Si semiconductor layer (having a thickness of 50 nm), an i-type a-Si semiconductor layer (having a thickness of 300 nm), a p-type a-Si semiconductor layer (having a thickness of 20 nm), and a p-type a-SiC semiconductor layer in this order, wherein the stable p-type a-SiC semiconductor layer forming the uppermost layer acts as a protective layer. FIG. 2C is a sectional view schematically illustrating a structure of an organic pn junction semiconductor substrate. A borosilicate glass substrate (having a thickness of 1.0 mm) has formed thereon a transparent electrode (ITO), an organic semiconductor layer of benzimidazole perylene (having a thickness of 50 nm), and a layer of copper phthalocyanine (having a thickness of 50 nm) in this order, wherein the copper phthalocyanine layer acts as a protective layer.

Figure 3:
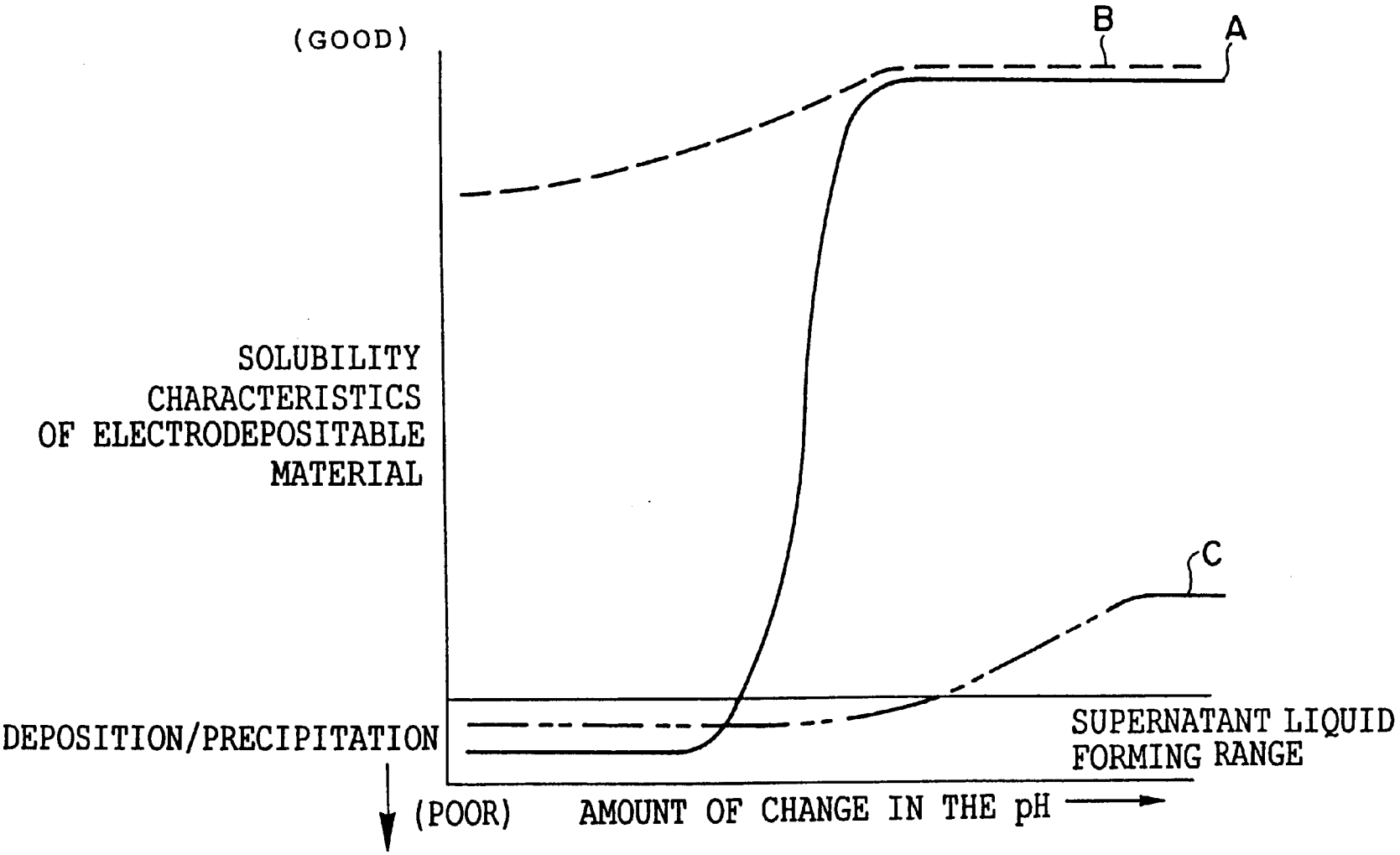
FIG. 3 is a graph indicating the solubility characteristics of electrodepositable materials depending on the change in the pH.

Solubility characteristics of electrodepositable materials depending on the change in the pH are shown in FIG. 3. The solubility characteristics serve as a criterion for selecting a material (electrodepositable material) capable of forming an electrodeposited film. FIG. 3 shows a graph indicating the relationships between the solubility characteristics of materials and the pH values of the solutions. The characteristics differ depending on the material, for example, materials of curve A (shown in as continuous line), which indicates the abrupt start of deposition at a threshold pH value; materials of curve B (shown as a broken line), which indicates good solubility irrespective of the pH value; and materials of curve C (shown as a double-dashed chain line), which indicates insolubility irrespective of the pH value. The characteristics also vary depending on the relationship between the material and a solvent (dispersing medium) for the material. In the present invention, preferred materials are those indicated by the curve A wherein deposition abruptly starts at a threshold pH value. Further, from the viewpoint of the stability of the image formed, it is ideal that the redissolving of the deposited material depending on the change in the pH is not abrupt but proceeds along a so-called hysteresis curve of the curve A and that the deposited state is maintained for a certain period of time. Therefore, it is preferable to select a combination of an electrodepositable material and a solvent having the above-described characteristics.

Any known ionic molecule can be used as an ionic molecule in the image forming method of the present invention, in so far as the ionic molecule is composed of an anionic or cationic molecule and the solubility of the ionic molecule varies as described above depending on the change in the pH. Specifically, typical examples of the ionic molecule are compounds such as triphenylmethane phthalides, phenoxazines, phenothiazines, fluoranes, indolyl phthalides, spiropyrans, azaphthalides, diphenylmethanes, chromenopyrazoles, leukoauramines, azomethines, rhodamine lactals, naphtholactams, triazines, triazoleazos, thiazoleazos, azos, oxazines, thiazines, benzthiazole azos, and quinoneimines.

As the electrodepositable material, these compounds can be used not only singly but also in combinations of two or more. Examples of possible combinations include: (1) a mixture of molecules having the same polarity such as a mixture of two or more anionic molecules or a mixture of two or more cationic molecules; (2) a mixture of molecules having different polarities such as a mixture of an anionic molecule and a cationic molecule; (3) a mixture of a dye and a pigment; and (4) a mixture of a polymer and a pigment. If two or more compounds have different hues, a mixed color is obtained. In a case where a mixture is used, it is necessary that the mixture contains at least one electrodepositable substance whose solubility varies depending on the change in the pH so that a thin film is formed by deposition. The presence of this electrodepositable substance enables a substance, which by itself is incapable of forming a thin film by deposition, to be brought into the electrodepositable substance to form an electrodeposited film and, as result, a mixed color is obtained.

For example, Rose Bengal or eosine, which are fluorescein dyes are in a reduced state and are soluble in water at a pH value of 4 or more but are oxidized to a neutral state and deposit/precipitate in water at a pH value of less than 4. Likewise, Pro Jet Fast Yellow 2, which is a diazo dye, and a certain water-soluble acrylic resin dissolve in water at a pH value of 6 or more but precipitate at a pH value of less than 6. If electrodes are immersed in a solution comprising any of these molecules dissolved in pure water and a voltage is applied, an electrodeposited film composed of these molecules is formed on the anode. The electrodeposited film can be redissolved in a solution either by applying a reverse voltage or by immersing the film in a solution having a pH value in the range of 10 to 12. As described above, Rose Bengal, eosine, and Pro Jet Fast Yellow 2 are each a material capable of forming an electrodeposited film by itself. If any of these materials is combined with an additional dye incapable of forming an electrodeposited film by itself, an electrodeposited film having a mixed color is obtained. In this case, the additional dye may or may not be ionic. Further, depending on the characteristics of the additional dye, a combination of materials each having a different polarity is also possible.

A case where two kinds of ions are mixed is discussed below. Generally, if a basic solution and an acidic solution are mixed together, neutralization takes place to precipitate a deposited material such as a complex. For this reason, when two or more dyes are mixed to produce a mixed color, a generally adopted practice is either using nonpolar pigments or dispersing materials having the same polarity. However, in a case where dyes of a certain type are mixed together, a complex is not formed and ionic substances can coexistent. In this case, since no deposit is formed even if a basic solution and an acidic solution are mixed together, even ions each having a different polarity can be used together. By utilizing this property, the present inventors have studied a case where two types of dye ions are mixed.

First, if an electrochemical oxidation is performed in a solution comprising a mixture of Rose Bengal (red), which is an anionic substance capable of forming an electrodeposited film, and Brilliant Blue (blue), which is an anionic substance incapable of forming an electrodeposited film, a purple electrodeposited film having the same color as that of the solution of the mixture is formed on the electrode. This is because a film-forming phenomenon takes place by taking the ions of the Brilliant Blue into the Rose Bengal (red) which is capable of forming an electrodeposited film. This example gives evidence that an electrodeposited film can be formed if one kind of the ions has a capability to form an electrodeposited film in a case where two kinds of ions having the same polarity are mixed.

Figure 4:
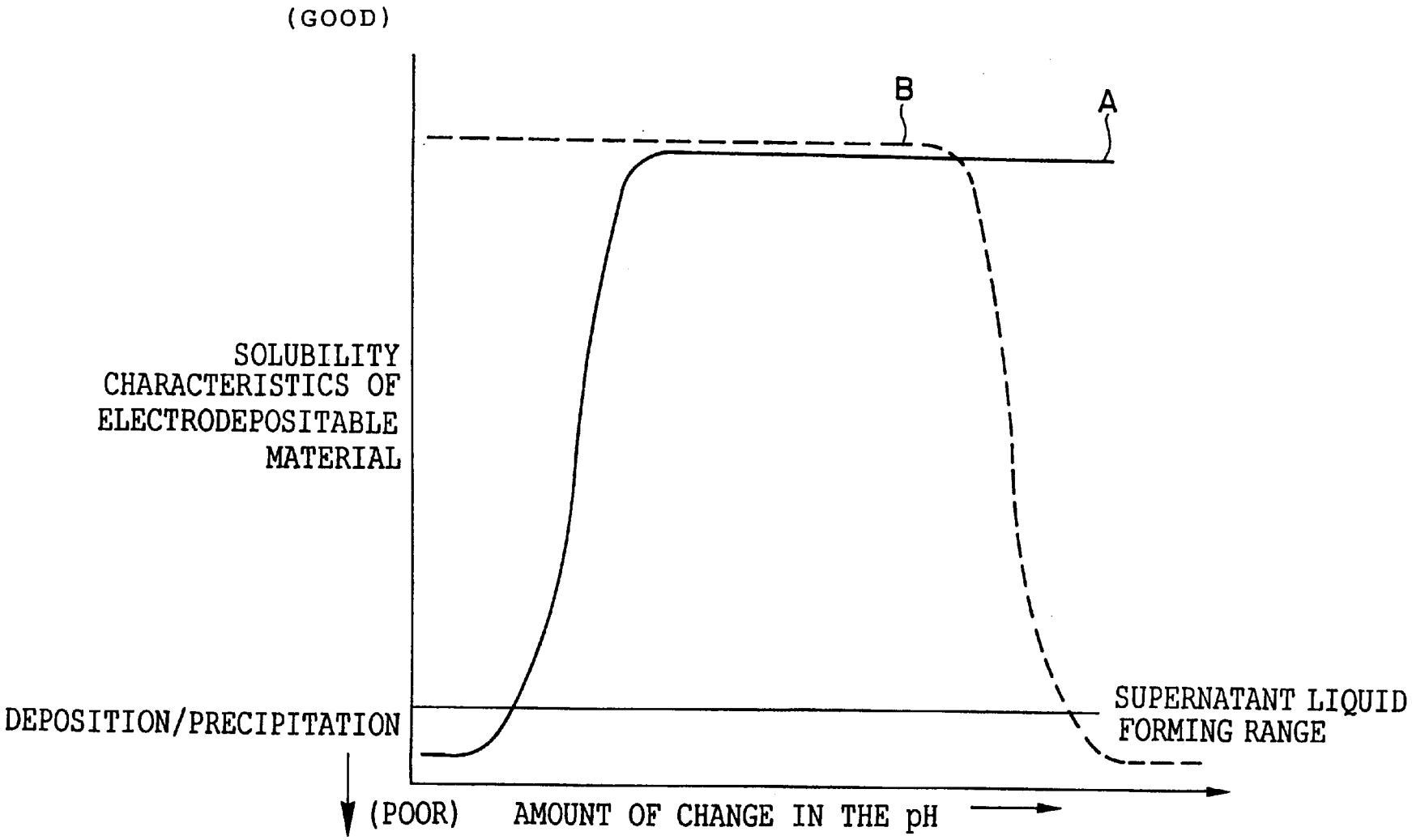
FIG. 4 is a graph indicating the solubility characteristics depending on the change in the pH of two electrodepositable materials which each have a different polarity and which can be used together.

Second, if an electrochemical oxidation is performed in a solution comprising two kinds of ions having different polarities, for example, a mixture of Pro Jet Fast Yellow 2 (yellow), which is an anionic substance capable of forming an electrodeposited film, and Cathilon Pure Blue 5GH (blue), which is a cationic substance capable of forming an electrodeposited film, a green electrodeposited film having the same color as that of the solution of the mixture is formed on the electrode. However, if an electrochemical reduction is performed, a blue electrodeposited film composed of Cathilon Pure Blue 5GH alone is formed on the electrode. The properties of such ionic compounds are hereinafter explained. For example, if one compound is soluble in a solvent within a neutral range but is abruptly deposited at a low pH value as illustrated by the curve A (continuous line) of FIG. 4, while another compound is soluble in a solvent within a neutral range but is abruptly deposited at a high pH value as illustrated by the curve B (broken line) of FIG. 4, these compounds can be used together, because high solubility is maintained in the neutral range but phase changes phase between dissolution and deposition occur at specific pH values. If the above-described characteristic is exhibited, an electrodeposited film comprising a different dye can be formed on the same electrode by merely changing the polarity of the voltage to be applied for the electrochemical reaction in a solution comprising a mixture of an anionic dye and a cationic dye.

If a pigment is used as the coloring material, the pigment is used together with an electrodepositable transparent or slightly colored polymeric material, such as a water-soluble acrylic resin or a water-soluble styrene resin, and the pigment is dispersed in an aqueous solution. When an electrodeposited film is formed as described above from the aqueous dispersion thus prepared, a colored electrodeposited film containing the pigment is obtained.

Next, the electrical conductivity and the pH are described. According to experiments conducted by the present inventors, the electrical conductivity relates to the electrodeposition rate, i.e., the relative deposited amount, such that, as the electrical conductivity increases, the thickness of the electrodeposited film per unit time period increases. The thickness becomes saturated at about 100 $mS/cm^2$ (see FIG. 5). Accordingly, if the dye ion alone cannot provide the required electrical conductivity, the electrodeposition rate can be controlled by an addition of an acidic or alkaline substance which does not adversely affect the electrodeposition characteristics, such as $Na^+$ ions or $Cl^-$ ions. If such a substance is added, the application of an voltage of 5V or less, for example, still enables the formation of an electrodeposited film.

Naturally, the pH of the aqueous solution also affects the formation of an electrodeposited film. For example, if the solubility of the dye molecule prior to the start of electrodeposition is saturated, the electrodeposited film thus formed does not easily redissolve. Conversely, if an electrodeposited film is formed from a solution at a pH value providing a solubility which is not saturated, the electrodeposited film thus formed starts redissolving immediately after the electric current stops. Therefore, it is desirable to carry out electrodeposition for film formation at a pH value which provides a saturated solubility of the dye molecule.

Next, the gradation of image is described. The gradation can be provided by changes in the thickness of the electrodeposited film, and the thickness of the electrodeposited film can be controlled by the amount of the electric current supplied during electrodeposition. The amount of the electric current to be supplied can be controlled by controlling at least one parameter selected from: (a) strength of the bias voltage to be applied, (b) time period of the irradiation with light, and (c) strength of the light for the irradiation. In short, the film thickness of the image to be formed can be controlled by the strength of the light, the bias voltage, and the time period for the application of the voltage, and, as a result, a toned image can be easily formed.

The image (electrodeposited film) thus obtained can be transferred to an appropriate transfer-receiving medium such as paper. Generally, image transfer can be performed by applying a voltage that is in reverse with respect to the voltage applied to form an electrodeposited film. However, even if a voltage is not applied, a transfer can be easily performed by changing the pH, because the difference in solubility depending on the pH of the dye molecule is utilized. That is, the transfer can be performed easily by bringing a surface upon which the electrodeposited film is formed into contact with a transfer-receiving medium whose surface is alkaline if the electrodeposited film is composed of anionic molecules, or alternatively, by bringing the surface upon which the electrodeposited film is formed into contact with a transfer-receiving medium whose surface is acidic if the electrodeposited film is composed of cationic molecules. Further, if the electrodepositable material has a melting point or a softening point, the transfer can be easily performed by bringing the surface upon which the electrodeposited film is formed into contact with the transfer-receiving medium and then applying heat, pressure, or heat and pressure to the electrodeposited film and the transfer-receiving medium, which are in contact with each other.

Referring now to FIGS. 6A–6E, the image forming method of the present invention is explained. As set forth previously, a transparent electroconductive film 14 is formed on a transparent substrate 12 (FIG. 6A), and a semiconductor thin film 16 is formed on the transparent electroconductive film 14. In this way, a substrate 18 (FIG. 6B) is prepared.

Figure 7:
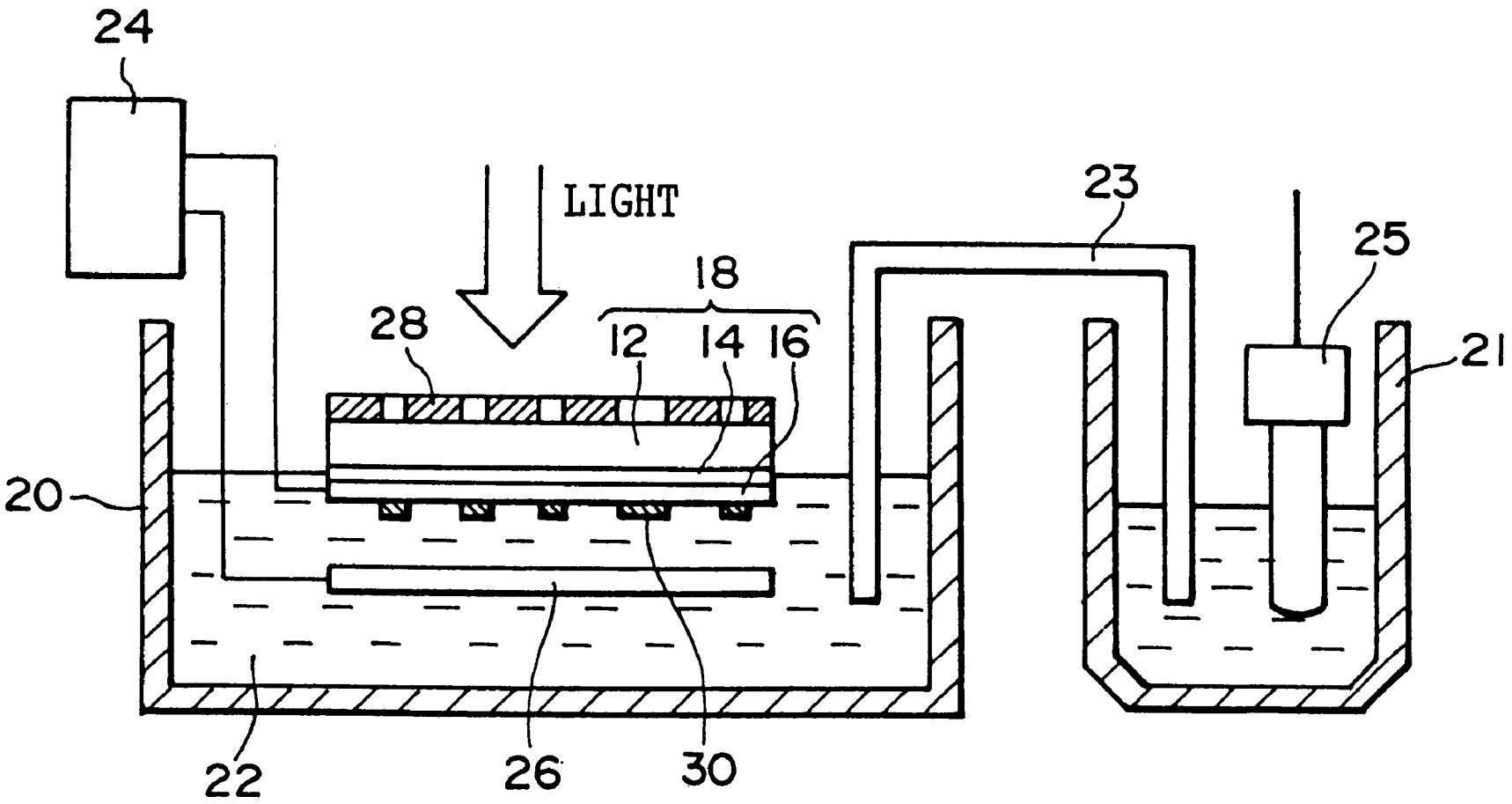
FIG. 7 is a structural diagram schematically illustrating an apparatus that was used for image formation in the examples of the present invention.

Next, as illustrated in FIG. 7, an apparatus having three electrodes, which is commonly employed in electrochemistry, is prepared. That is, a vessel 20 capable of holding a liquid is filled with an aqueous liquid 22 containing a coloring material and an electrodepositable material capable of chemically dissolving or depositing/precipitating depending on the change in the pH. Further, in the vessel 20 is fixed the substrate 18 wherein the transparent electroconductive film 14 is connected to a means 24 for supplying an electric current or an electric field at least in conformity to an image pattern, such that the semiconductor thin film (electrode) 16 is immersed in the aqueous liquid 22. A counter electrode 26 constituting another electrode of an electrode pair is also placed in the vessel 20. On the other hand, a saturated calomel electrode is placed in a vessel 23 filled with a saturated aqueous solution of potassium chloride which serves as a reference liquid interface, and a salt bridge 27 is disposed between the vessel 22 containing the electrodepositable material and the vessel 23. In this case, the $TiO_2$ electrode 16 functions as a working electrode with respect to the saturated calomel electrode 25.

Figure 6A:
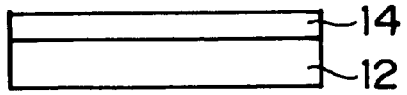
FIGS. 6A–6E are sectional views schematically illustrating an image forming process of the present invention.
Figure 6B:
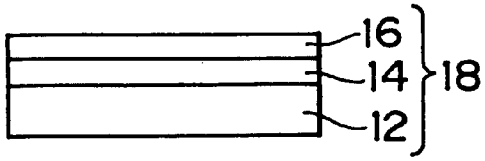
Figure 6C:
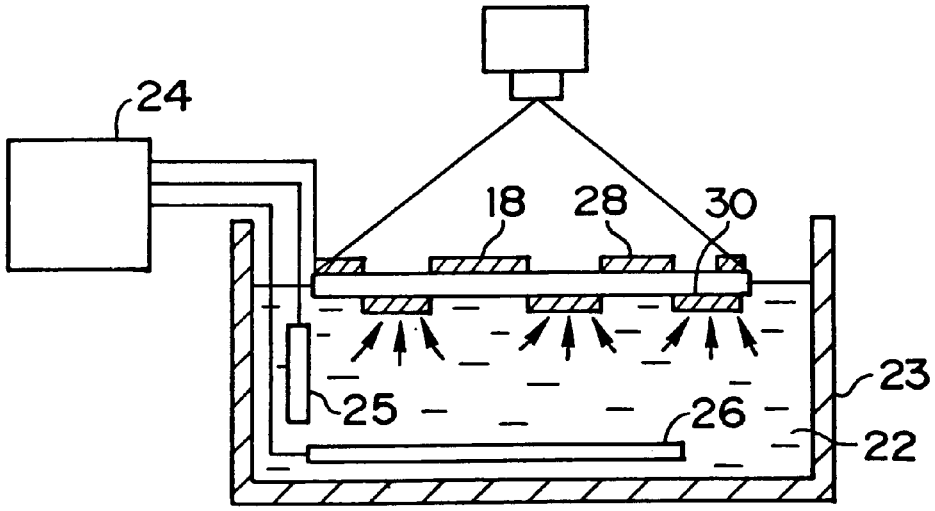
Figure 6D:
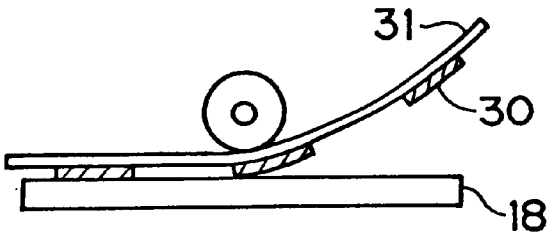
Figure 6E:
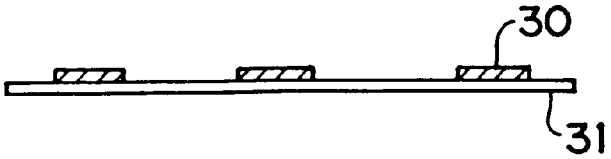

If a prescribed mask pattern 28 is disposed on the transparent substrate 12 of the substrate 18 and then irradiation with light is carried out, a colored electrodeposited film 30 containing the electrodepositable material and the coloring material is deposited selectively on portions where electromotive force is generated by the irradiation, thereby forming an image (FIG. 6C). The colored film 30 is fixed by taking out the substrate 18 having the colored electrodeposited film formed thereon from the aqueous liquid 22 and then removing the solvent. In this case, the portions on which electromotive force is generated are determined by disposing the mask pattern 28. However, it is also possible to generate electromotive force on predetermined portions by directly writing with laser light without using the mask pattern 28. The image 30 can also be transferred to a transfer-receiving medium 31 such as paper (FIGS. 6D and 6E)

The electrode potentials of the saturated calomel electrode at 20° C., 25° C., and 30° C. are 0.2444V, 0.2412V, and 0.23878V, respectively. Therefore, these potentials are substantially equal to a ground level potential, i.e., 0V. When forming an image, although a vessel (electrolyte) in a state of ground connection can be used without using the saturated calomel electrode, the electrolyte may be connected to the saturated calomel electrode so that the surface potential of the electrolyte is set to the standard potential of the saturated calomel electrode as described above, in order to clarify the potential of the working electrode (i.e., the electrode on which a deposit is formed).

Next, an exposure apparatus for use in the preparation of the photoelectrodeposited film is described. Examples of methods of exposure include a scanning exposure method using a laser as a light source and a total-surface exposure method using a mask pattern. If the latter is employed, the desired light source is a uniformly irradiating light source which is capable of irradiating the entire surface of the substrate uniformly.

The wavelength of the light for the irradiation is determined such that the wavelength is within the range in which the semiconductor is sensitive. Examples of the light source which can ordinarily be used favorably include a mercury lamp, a mercury/xenon lamp, a cannon lamp, a He/Cd laser, a He/Ne laser, an $N_2$ laser, an excimer laser, and a semiconductor laser.

Figure 8:
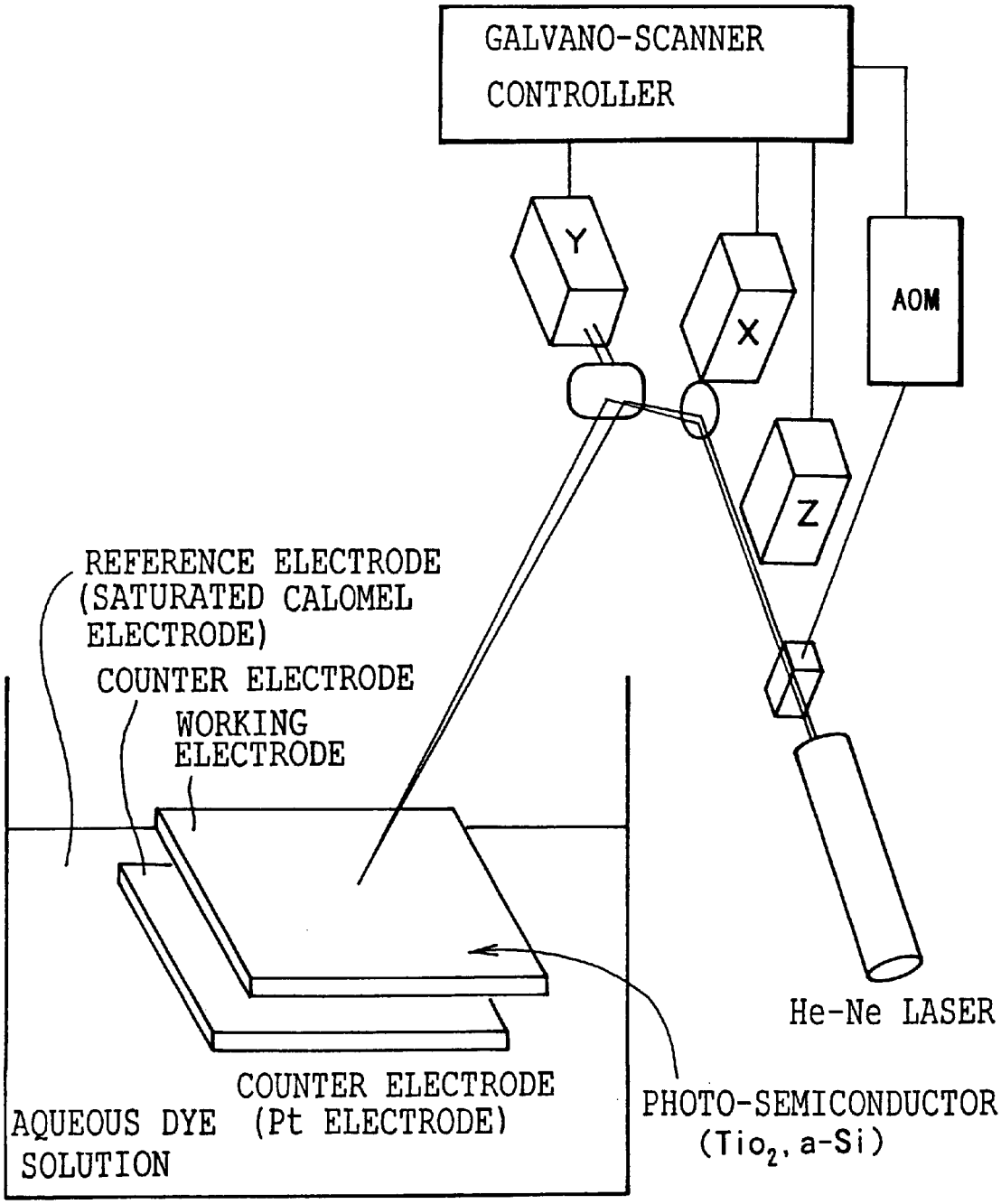
FIG. 8 is a structural diagram schematically illustrating an image forming apparatus in which the irradiation with light is carried out with scanning exposure by means of a He—Ne laser.

As for the exposure apparatus, an image forming apparatus can be used that is based on a total-surface exposure system using a mask pattern as schematically illustrated in FIG. 7. Further, an image forming apparatus that is based on a scanning exposure using a He/Ne laser for the irradiation with light required for image formation as schematically illustrated in FIG. 8, can also be used. This apparatus enables unrestricted image-wise exposure wherein image information is inputted in a scanner controller without relying on a prescribed pattern.

Figure 9:
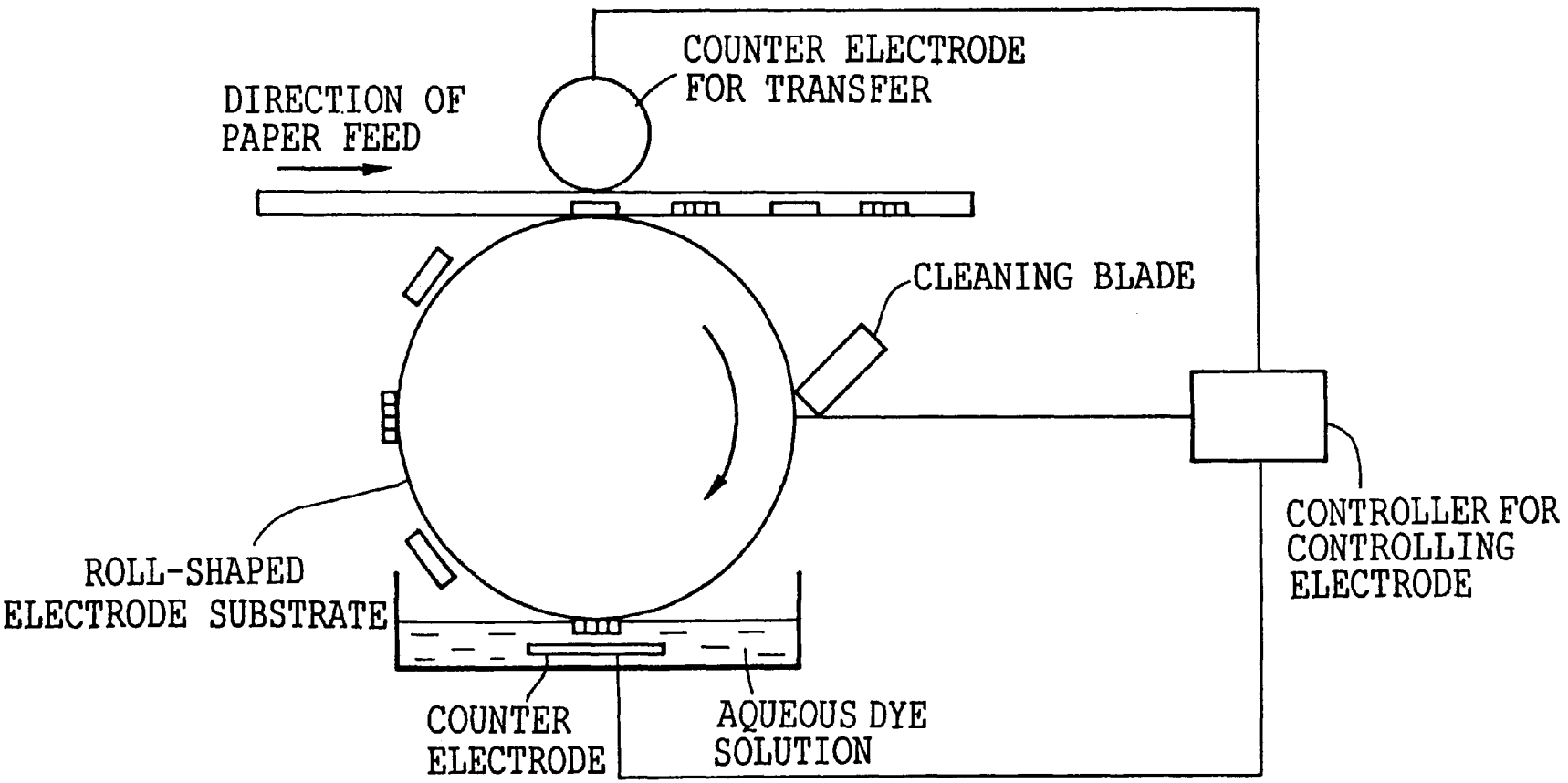
FIG. 9 is a structural diagram schematically illustrating an apparatus is designed for continuous image formation with a roll-shaped electrode substrate.

In order to carry out continuously an image forming operation including the formation of an electrodeposited film and the transfer thereof, a continuous image forming apparatus, which has a roll-shaped electrode substrate as schematically illustrated in FIG. 9, can also be used. The image forming apparatus of the present invention is not limited to the apparatus described above, and various modifications are possible by combining known members in so far as the structural elements of the apparatus of the present invention are included.

EXAMPLES

The following examples illustrate the present invention. They are not to be construed to limit the scope of the present invention.

Example 1

As illustrated in FIG. 2A, a 200 nm thick $TiO_2$ layer was vapor-deposited on an ITO substrate by EB (electron beam) vapor deposition. The $TiO_2$ layer was subjected to a reduction process so as to increase the electrical conductivity of the semiconductor. The reduction process comprised annealing the layer at 350° C. for 10 minutes in an atmosphere composed of 3% of hydrogen gas and pure nitrogen gas. Then, as illustrated in FIG. 7, by using an apparatus having three electrodes, which is commonly employed in electrochemistry, the substrate was placed in a 0.02M aqueous solution of Pro Jet Fast Yellow 2, wherein the $TiO_2$ electrode served as a working electrode with respect to the saturated calomel electrode. When the working electrode was set to 2.0V and the backside of the substrate was irradiated for 10 seconds through a photomask with the light of a mercury/xenon lamp, an image composed of a thin film of the Pro Jet Fast Yellow 2 was formed only on portions of the $TiO_2$ surface irradiated with the light.

When the $TiO_2$ substrate upon which the image was formed was brought into contact with paper containing an aqueous alkaline solution having a pH value of 10, the Pro Jet Fast Yellow 2 redissolved and, as a result, the image was transferred to the paper.

Example 2

As illustrated in FIG. 2A, a 100 nm thick ITO transparent electroconductive film was prepared by sputtering on a 1 mm thick glass substrate and a 250 nm thick $TiO_2$ layer was then prepared on the ITO substrate. Subsequently, in order to improve the photocurrent characteristics of the $TiO_2$ layer, a reduction process was performed. The reduction process comprised annealing the layer at 350° C. for 10 minutes in an atmosphere composed of 3% of hydrogen gas and pure nitrogen gas. Then, as in Example 1, by using an apparatus having three electrodes, which is commonly employed in electrochemistry, the substrate was placed in an aqueous liquid comprising a styrene/acrylic acid copolymer (having a molecular weight of 13,000, a molar ratio of hydrophobic groups to the sum of hydrophilic groups and hydrophobic groups of 65%, and an acid value of 150) and ultra-fine azo-based red pigment particles dispersed therein such that solid weight ratio of the copolymer to the pigment was 1:1, wherein the $TiO_2$ electrode served as a working electrode with respect to the saturated calomel electrode. When the working electrode was set to 1.7V and the backside of the substrate was irradiated for 10 seconds through a photomask with the light of a mercury/xenon lamp (manufactured by Yamashita Denso Corporation, having a light strength of 50 $mW/cm^2$ at a wavelength of 365 nm), an image composed of a red thin film was formed only on portions of the $TiO_2$ surface irradiated with the light.

When the $TiO_2$ substrate upon which the image was formed was brought into contact with paper and pressed against the paper while heating the substrate to 150° C., the red image was transferred to the paper.

Example 3

As illustrated in FIG. 2B, a substrate was prepared by forming on a borosilicate glass substrate, which had an $SnO_2$ transparent electroconductive film vapor-deposited thereon, a 50 nm thick n-type a-Si, a 300 nm thick i-type a-Si, a 20 nm thick p-type a-Si, and a 20 nm thick p-type a-SiC in this order. Then, as illustrated in FIG. 7, by using an apparatus having three electrodes, which is commonly employed in electrochemistry, the a-Si substrate thus prepared having a pin structure was placed in an aqueous solution containing 0.02M of Pro Jet Fast Yellow 2, wherein the $SnO_2$ electrode served as a working electrode with respect to the saturated calomel electrode. When the working electrode was set to 1.8V and the backside of the substrate was irradiated for 10 seconds through a photomask with the light of a xenon lamp, a yellow image composed of a thin film of the Pro Jet Fast Yellow 2 was formed only on portions of the p-SiC surface irradiated with the light.

When the pin substrate upon which this image was formed was brought into contact with paper containing an aqueous alkaline solution having a pH value of 10, the Pro Jet Fast Yellow 2 redissolved and, as a result, the yellow image was transferred to the paper.

Example 4

As illustrated in FIG. 2C, an organic pn junction substrate was prepared by forming on a borosilicate glass substrate, which had a transparent electroconductive (ITO) film formed thereon, a 50 nm thickbenzimidazole perylene layer which is a perylene derivative and a 50 nm thick copper phthalocyanine layer in this order. Then, as illustrated in FIG. 7, by using an apparatus having three electrodes, which is commonly employed in electrochemistry, the substrate thus prepared was placed in a 0.02M aqueous solution of Pro Jet Fast Yellow 2, wherein the transparent electroconductive electrode served as a working electrode with respect to the saturated calomel electrode. When the working electrode was set to 1.8V and the backside of the substrate was irradiated for 10 seconds through a photomask with the light of a xenon lamp, a yellow image composed of the Pro Jet Fast Yellow 2 was formed only on portions of the copper phthalocyanine surface layer irradiated with the light.

When the pin substrate upon which the image was formed was brought into contact with paper containing an aqueous alkaline solution having a pH value of 10, the Pro Jet Fast Yellow 2 redissolved and, as a result, the yellow image was transferred to the paper.

Example 5

As illustrated in FIG. 2B, a substrate was prepared by forming on a borosilicate glass substrate, which had an $SnO_2$ transparent electroconductive film vapor-deposited thereon, a 50 nm thick p-type a-Si, a 300 nm thick i-type a-Si, a 20 nm thick n-type a-Si, and a 20 nm thick a-SiC in this order. Then, as illustrated in FIG. 7, by using an apparatus having three electrodes, which is commonly employed in electrochemistry, the a-Si substrate thus prepared having a pin structure was placed in a 0.02M aqueous solution of Chathilon Pure Blue 5GH, wherein the $SnO_2$ electrode served as a working electrode with respect to the saturated calomel electrode. When the working electrode was set to −0.7V and the backside of the substrate was irradiated for 10 seconds through a photomask with the light of a xenon lamp, a blue image composed of a thin film of the Chathilon Pure Blue 5GH was formed only on portions of the n-Sic surface irradiated with the light.

When the pin substrate upon which this image was formed was brought into contact with paper containing an aqueous acidic solution having a pH value of 5, the Chathilon Pure Blue 5GH redissolved and, as a result, the blue image was transferred to the paper.

Example 6

As illustrated in FIG. 2A, a 100 nm thick transparent electroconductive ITO film was prepared by sputtering on a 1 mm thick glass substrate. Then, a 250 nm thick $TiO_2$ film was formed by a sol-gel method on the ITO thin film. That is, the $TiO_2$ film was formed by a process comprising spin-coating a layer of an alkoxide of $TiO_2$ (Atron NTi-092 manufactured by Nippon Soda Co., Ltd.) for 20 seconds at 1,500 rpm on the ITO substrate and then heating the resulting coated layer at about 500° C. for 1 hour. As in Example 1, for the purpose of reduction, the substrate was annealed at 350° C. for 10 minutes in an atmosphere composed of 3% of hydrogen gas and pure nitrogen gas. Then, as illustrated in FIG. 7, by using an apparatus having three electrodes, which is commonly employed in electrochemistry, the substrate was placed in a mixture of a 0.01M aqueous solution of Pro Jet Fast Yellow 2 and a 0.01M aqueous solution of Chathilon Pure Blue 5GH, wherein the $TiO_2$ electrode served as a working electrode with respect to the saturated calomel electrode. When the working electrode was set to 2.0V and the backside of the substrate was irradiated for 10 seconds through a photomask with the light of a mercury/xenon lamp (manufactured by Yamashita Denso Corporation, having a light strength of 50 $mW/cm^2$ at a wavelength of 365 nm), a green image was formed only on portions of the $TiO_2$ surface irradiated with the light.

When the $TiO_2$ substrate upon which the image was formed was brought into contact with paper and pressed against the paper while heating the substrate to 150° C., the green image was transferred to the paper.

Example 7

As in Example 6, a 200 nm thick $TiO_2$ film was formed by a sol-gel method on the ITO substrate. That is, the $TiO_2$ film was formed by a process comprising spin-coating a layer of an alkoxide of $TiO_2$ on the ITO substrate and then heating the resulting coated layer at about 550° C. for 1 hour. As in Example 1, for the purpose of reduction, the substrate was annealed at 350° C. for 10 minutes in an atmosphere composed of 3% of hydrogen gas and pure nitrogen gas. Then, as illustrated in FIG. 7, by using an apparatus having three electrodes, which is commonly employed in electrochemistry, the substrate was placed in a 0.02M aqueous solution of Pro Jet Fast Yellow 2, wherein the $TiO_2$ electrode served as a working electrode with respect to the saturated calomel electrode. The working electrode was set to 2.0V and the backside of the substrate was exposed image-wise by means of a galvano-scanner using a He—Cd laser as a light source. The scanning speed of the laser was 1 mm/sec. The scanning produced a yellow image of a thin film of the Pro Jet Fast Yellow 2 only on portions of the $TiO_2$ surface irradiated with the light.

When the $Tio_2$ substrate upon which the image was formed was brought into contact with paper containing an aqueous alkaline solution having a pH value of 10, the Pro Jet Fast Yellow 2 redissolved and, as a result, the yellow image was transferred to the paper.

Example 8

As in Example 3, a substrate was prepared by forming on a borosilicate glass substrate, which had a $SnO_2$ transparent electrode vapor-deposited thereon, a 50 nm thick n-type a-Si, a 300 nm thick i-type a-Si, a 20 nm thick p-type a-Si, and a 20 nm thick p-type a-SiC in this order. Then, as illustrated in FIG. 7, by using an apparatus having three electrodes, which is commonly employed in electrochemistry, the a-Si substrate thus prepared having a pin structure was placed in a 0.02M aqueous solution of Pro Jet Fast Yellow 2, wherein the $SnO_2$ electrode served as a working electrode with respect to the saturated calomel electrode. The working electrode was set to 1.8V and the backside of the substrate was image-wise exposed by means of a galvano-scanner using a He—Ne laser as a light source. The scanning speed of the laser was 1 mm/sec. The scanning produced a yellow image of a thin film of the Pro Jet Fast Yellow 2 only on portions of the p-SiC surface irradiated with the light.

When the pin substrate upon which the image was formed was brought into contact with paper containing an aqueous alkaline solution having a pH value of 10, the Pro Jet Fast Yellow 2 redissolved and, as a result, the yellow image was transferred to the paper.

Example 9

Figure 5:
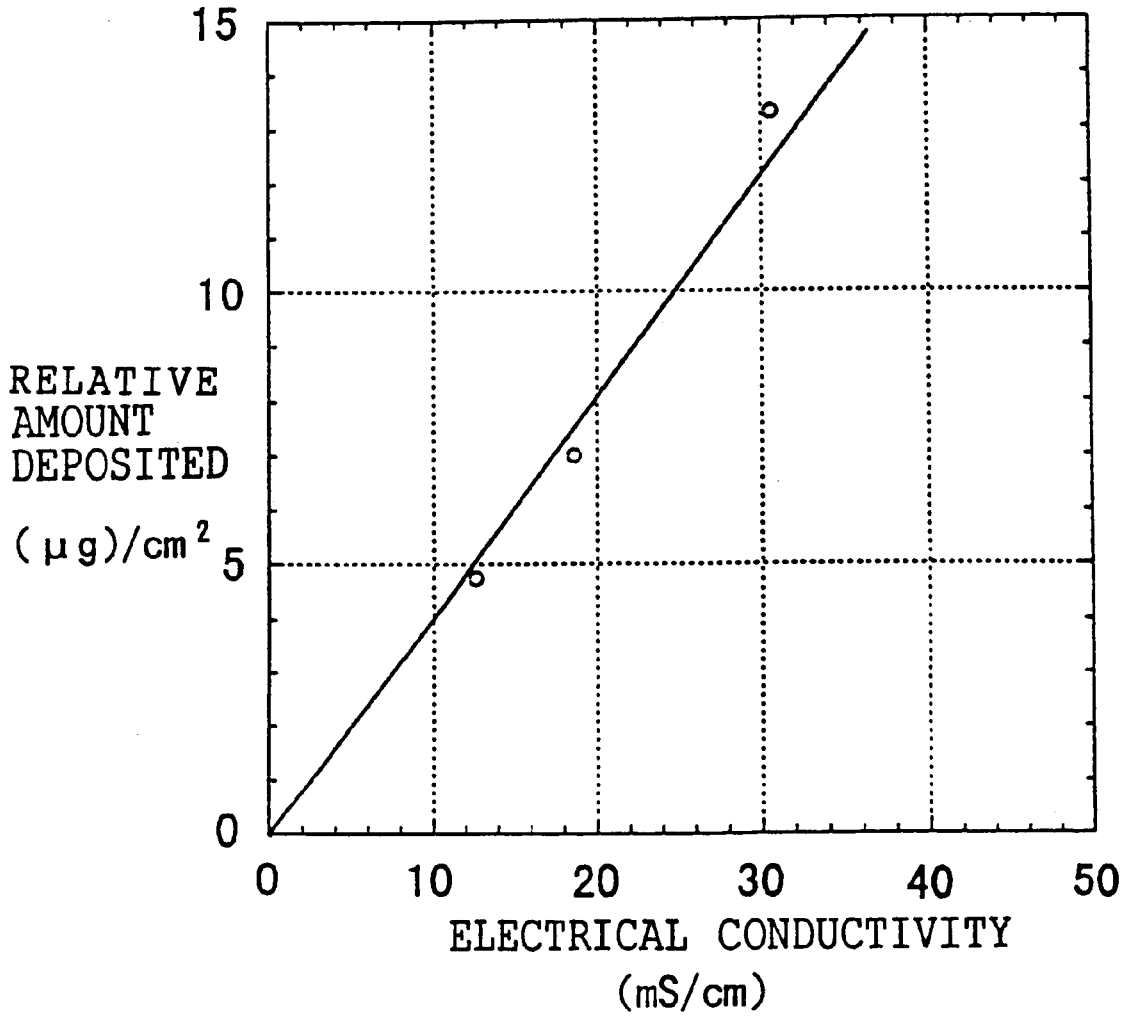
FIG. 5 is a graph indicating the change in the electrodeposited amount of an electrodepositable material depending on the change in the electrical conductivity.

The relationship between the deposited amount and the electrical conductivity was examined by measuring the amount of a dye deposited in a certain time period by means of a QCM method (quartz oscillator micro-balance method) while the electrical conductivity was varied. A 0.01M aqueous solution of Pro Jet Fast Yellow 2 was used as the electrodepositable material and the electrical conductivity was changed by the addition of NaCl. The QCM apparatus was manufactured by Hokuto Electric Industries, Co., Ltd., which used an Au electrode prepared by ion-plating. The electrodeposited amount is the amount of change in the frequency of the quartz oscillator and is proportional to the amount of the dye electrodeposited. As illustrated in FIG. 5, the deposited amount was substantially proportional to the electrical conductivity up to about 50 mS/cm, but thereafter the deposited amount became saturated at about 100 mS/cm.

Example 10

As illustrated in FIG. 2A, a 100 nm thick transparent electroconductive ITO film was vapor-deposited by sputtering on a 1 mm thick glass substrate. Then, a 250 thick $TiO_2$ film was formed by a sol-gel method on the ITO thin film. That is, the $TiO_2$ film was formed by a process comprising spin-coating a layer of an alkoxide of $TiO_2$ (Atron NTi-092 manufactured by Nippon Soda Co., Ltd.) for 20 seconds at 1,500 rpm on the ITO substrate and then heating the resulting coated layer at about 500° C. for 1 hour. As in Example 1, for the purpose of reduction, the substrate was annealed at 350° C. for 10 minutes in an atmosphere composed of 3% of hydrogen gas and pure nitrogen gas. Then, as in Example 1, by using an apparatus having three electrodes, which is commonly employed in electrochemistry, the substrate was placed in an aqueous liquid comprising a styrene/acrylic acid copolymer (having a molecular weight of 13,000, a molar ratio of hydrophobic groups to the sum of hydrophilic groups and hydrophobic groups of 65%, and an acid value of 150) and ultra-fine phthalocyanine pigment particles dispersed therein such that the solid weight ratio of the copolymer to the pigment was 1:1, wherein the $TiO_2$ electrode served as a working electrode with respect to the saturated calomel electrode. When the working electrode was set to 1.8V and the backside of the substrate was irradiated for 10 seconds with the light of a mercury/xenon lamp (manufactured by Yamashita Denso Corporation, having a light strength of 50 mW/cm$^2$ at a wavelength of 365 nm) through a photomask, which had been prepared in advance such that only portions designed for being colored in cyan transmit light, an image composed of a cyan thin film was formed only on portions of the $TiO_2$ surface irradiated with the light.

After being washed with water, the substrate having the image as described above was placed in an aqueous liquid comprising a styrene/acrylic acid copolymer (having a molecular weight of 13,000, a molar ratio of hydrophobic groups to the sum of hydrophilic groups and hydrophobic groups of 65%, and an acid value of 150) and ultra-fine azo-based magenta pigment particles dispersed therein such that the solid weight ratio of the copolymer to the pigment was 1:1, wherein the $TiO_2$ electrode served as a working electrode with respect to the saturated calomel electrode. When the working electrode was set to 1.8V and the backside of the substrate was irradiated for 10 seconds with the light of a mercury/xenon lamp (manufactured by Yamashita Denso Corporation, having a light strength of 50 mW/cm$^2$ at a wavelength of 365 nm) through a photomask, which had been prepared in advance such that only portions designed for being colored in magenta transmit light, an image composed of a magenta thin film was formed only on the portions of the $TiO_2$ surface irradiated with the light. In this way, an image in two colors, i.e., cyan and magenta, was formed.

After being washed with water, the substrate having the image as described above was placed in an aqueous liquid comprising a styrene/acrylic acid copolymer (having a molecular weight of 13,000, a molar ratio of hydrophobic groups to the sum of hydrophilic groups and hydrophobic groups of 65%, and an acid value of 150) and ultra-fine azo-based yellow pigment particles dispersed therein such that the solid weight ratio of the copolymer to the pigment was 1:1 wherein the $TiO_2$ electrode served as a working electrode with respect to the saturated calomel electrode. When the working electrode was set to 1.8V and the backside of the substrate was irradiated for 10 seconds with the light of a mercury/xenon lamp (manufactured by Yamashita Denso Corporation, having a light strength of 50 mW/cm$^2$ at a wavelength of 365 nm) through a photomask, which had been prepared in advance such that only portions designed for being colored in yellow transmit light, an image composed of a yellow thin film was formed only on portions of the $TiO_2$ surface irradiated with the light. In this way, an image in three colors, i.e., cyan, magenta, and yellow, was formed.

After being washed with water, the substrate having the image as described above was placed in an aqueous liquid comprising a styrene/acrylic acid copolymer (having a molecular weight of 13,000, a molar ratio of hydrophobic groups to the sum of hydrophilic groups and hydrophobic groups of 65%, and an acid value of 150) and carbon black (having an average diameter of 80 nm) dispersed therein such that the solid weight ratio of the copolymer to the pigment was 1:1, wherein the $TiO_2$ electrode served as a working electrode with respect to the saturated calomel electrode. When the working electrode was set to 1.6V and the backside of the substrate was irradiated for 10 seconds with the light of a mercury/xenon lamp (manufactured by Yamashita Denso Corporation, having a light strength of 50 mW/cm$^2$ at a wavelength of 365 nm) through a photomask, which had been prepared in advance such that only portions designed for being colored in black transmit light, an image composed of a black thin film was formed only on portions of the $TiO_2$ surface irradiated with the light. In this way, a full-color image in four colors was formed.

When the $TiO_2$ substrate having the image was brought into contact with paper and pressed against the paper while heating the substrate to 150° C., the full-color image was transferred to the paper.

The image forming method of the present invention. provides excellent effects wherein an image composed of an electrodeposited film can be formed on an organic or inorganic semiconductor substrate by an application of a voltage as low as several volts, and the use of a semiconductor capable of generating photovoltaic force makes it possible to form an image of an electrodeposited film in accordance with the strength of the light only on irradiated portions.

Further, use of the image forming apparatus of the present invention makes it possible to form easily a high-quality image characterized by high resolution and ease in controlling gradation.

What is claimed is:

1. A method for forming a coloring material deposited film, comprising the steps of:

bringing a holding member having a surface for holding a coloring material deposited film and which is able to function as one of a pair of electrodes into contact with a coloring material fine particle dispersion comprising color material fine particles dispersed in an aqueous liquid; and adhering and depositing coloring material fine particles onto the holding member by changing the dispersion stability of the coloring material fine particles by changing the pH value of the coloring material fine particle dispersion by energizing via the dispersion a counter electrode which is the other one of the pair of electrodes and a desired portion.

2. A method for forming a coloring material deposited film according to claim 1, wherein while the energizing is being performed, foaming caused by electrolysis of the dispersion is suppressed.

3. A method for forming a coloring material deposited film according to claim 1, wherein the holding member further comprises a photoconductive substance capable of converting input light into a current signal, and the energizing is performed by irradiating light onto the photoconductive substance.

4. A method for forming a coloring material deposited film according to claim 3, wherein the energizing is performed by light irradiation and bias voltage application.

5. A method for forming a coloring material deposited film according to claim 3, wherein the holding member comprises a transparent substrate and the light irradiation is carried out on the opposite side to the photoconductive substance.

6. A method for forming a coloring material deposited film, comprising the steps of:

bringing a photo-semiconductor film of a holding member comprising a transparent electroconductive film and a photo-semiconductor film into contact with a coloring material fine particle dispersion comprising ionized coloring material fine particles dispersed in an aqueous liquid; and adhering and depositing coloring material fine particles onto the holding member by changing the dispersion stability of the coloring material fine particles by changing the pH value of the coloring material fine particle dispersion by irradiating light onto the photo-semiconductor film.

7. A method for forming a coloring material deposited film according to claim 6, wherein while the light irradiation is being performed, foaming caused by electrolysis of the dispersion is suppressed.

8. A coloring material deposited film holding member comprising laminations thereon on the following order:

a transparent substrate;

a transparent electroconductive film;

a photoconductive film; and a coloring material deposited film having a thickness of not more than 2 microns.

* * * * *